US005318302A

United States Patent [19]

Moscovich et al.

[11] Patent Number: 5,318,302

[45] Date of Patent: Jun. 7, 1994

[54] MAGNETIC PUZZLE

[76] Inventors: Ivan Moscovich, 21 Seymour Street Flat 39, London W1H 5AD, England; Jan Essebaggers, Burg. Vogelaarsingel 11, 2912 BB Nieuwerkerk A/D Ijssel, Netherlands

[21] Appl. No.: 9,857

[22] Filed: Jan. 26, 1993

[51] Int. Cl.[5] ..... A63F 9/08; G09B 23/18

[52] U.S. Cl. ..... 273/155; 273/253 S; 434/301

[58] Field of Search ..... 273/153 R, 153 S, 155, 273/157 R; 434/301

[56] References Cited

U.S. PATENT DOCUMENTS

| | | | |
|---|---|---|---|
| 3,655,201 | 4/1972 | Nichols | 273/153 S |
| 4,267,647 | 5/1981 | Anderson, Jr. et al. | 434/301 |
| 4,402,510 | 9/1983 | Yokoi | 273/153 S |
| 4,404,766 | 9/1983 | Toth | 434/301 |
| 4,886,273 | 12/1989 | Unger | 273/157 R |

*Primary Examiner*—Vincent Millin
*Assistant Examiner*—Steven B. Wong
*Attorney, Agent, or Firm*—Jabobson, Price, Holman & Stern

[57] ABSTRACT

A puzzle using two layers of sixteen small, thin, disc type magnets in an upper and lower matrix of 4×4 each, whereby the top layer of revolving magnets are colored in two colors at the north and south pole of the magnets, and are horizontally confined to their place, but can turn around showing either one of the colors while the lower layer is confined vertically and whereby each of the magnets can change its position within the lower matrix by a mechanism of sliding bars in x and y direction, thereby maintaining its original north-south direction. This mechanism enables each of the confined individual magnets in the lower layer (matrix) to move around whereby always four magnets in a row are moved one position in the matrix either in x or y direction. By moving the lower layer of magnets, the direction of the upper layer is influenced by the magnetic forces acting on one or more magnets and thereby turning the magnet over when two equal poles meet thereby showing either one of the said colors at the time depending on which side is attracted by the magnet underneath in the lower matrix. The objective of the magnetic puzzle is to get a surface of equal colored magnets in the upper layer, by moving the individual position of the magnets in the lower matrix of magnets.

7 Claims, 6 Drawing Sheets

MAGNETIC PUZZLE

SUMMARY OF THE INVENTION

A magnetic puzzle of two layers of sixteen small disc type magnets in an upper and lower matrix of 4×4 each, whereby the upper layer of revolving magnets is colored in two colors, one color on each pole, whereby each magnet is confined to its lateral position but whereby each magnet can turn over without changing its position within the said upper matrix. The lower layer of magnets are confined vertically, but whereby each of the magnets can take all positions within the said lower matrix, however, cannot turn around thereby maintaining the north and south pole in the same direction.

The direction of the individual magnets in the upper layer of magnets is influenced by the north-south position of the lower magnets by the interacting magnetic forces on each of the individual magnets, thereby showing either one of the said colors on the visible side.

The coloring of the upper layer of magnets is such, that there is at least one combination of upper and lower magnets whereby all upper magnets show the same color and the upper matrix of magnets is uniformly colored on the visible side.

The movements of the magnets within the said lower matrix is obtained by moveable sliding bars in x and y direction whereby always one complete row of magnets is moved one position within the said matrix at the time. For a matrix of 4×4 there are four sliding bars in x-direction and four sliding bars in the y-direction. By the movements of the said sliding bars in the x and y direction the magnets in the lower matrix can take on all positions in the said lower matrix. While the 4×4 matrix of the upper layer of confined magnets is positioned directly above the lower layer of magnets, each magnet in the lower matrix will influence the direction of the upper magnet thereby turning one of the colors to the visible side of the puzzle. The north-south direction of the magnets in the upper and lower matrix of magnets could be arbitrarily, however, there is at least one combination of upper and lower magnets in the matrix whereby all visible sides of the upper layer of magnets are uniformly colored, being the solution of the puzzle.

The objective of the puzzle is not necessarily to color the visible side of the puzzle uniformly into one color. Other objectives are envisioned by printing letters or pictures on one or both sides of the magnets in the said upper layer matrix. In that case the solution to the puzzle may be a sentence or a complete picture obtained by the proper position of the individual magnets in the lower matrix.

SHORT DESCRIPTION OF THE FIGURES

FIGS. 1A–1C are a plan view, side view and end view of a two layer matrix of 4×4 magnets shown schematically of which the upper layer of magnets are confined horizontally, but can turn over while the lower layer of magnets are vertically confined but wherein each magnet can take any horizontal position within the matrix. Two such magnets from the matrix are shown in FIG. 1-D whereby the direction of the upper magnet and thereby the coloring, is influenced by the position of the lower magnet.

Figure 3:
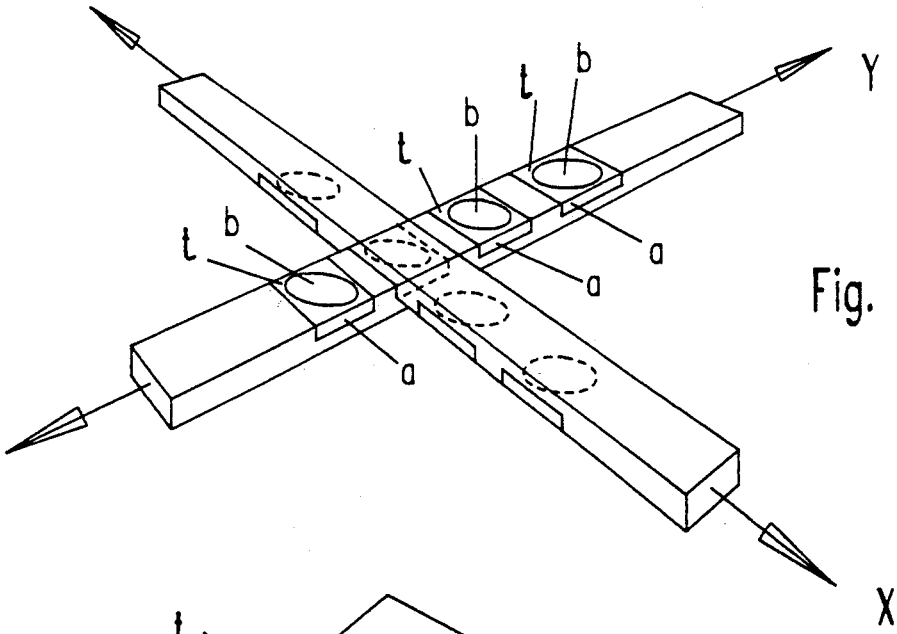
FIG. 3 shows two of the 8 sliding bars in perspective view used in the mechanism of moving magnets of FIG. 2.
Figure 4:
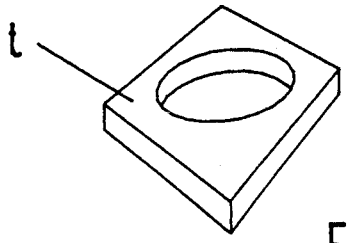
FIG. 4 shows one out of sixteen square sliding piece (tiles) holding a magnet in the lower matrix of magnets.
Figure 5A:
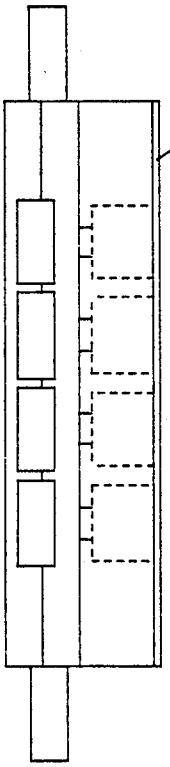
Figure 5B:
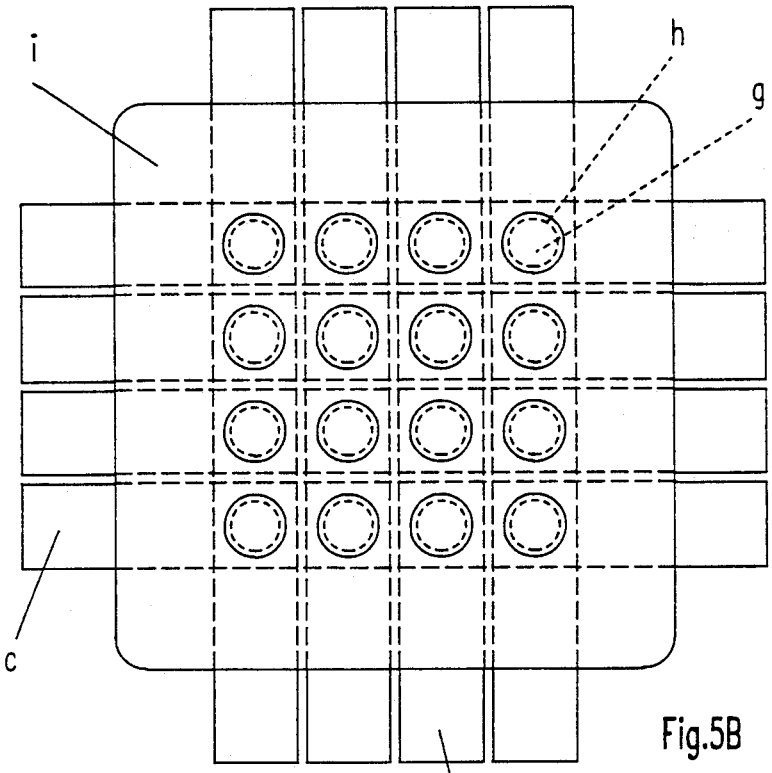
Figure 5C:
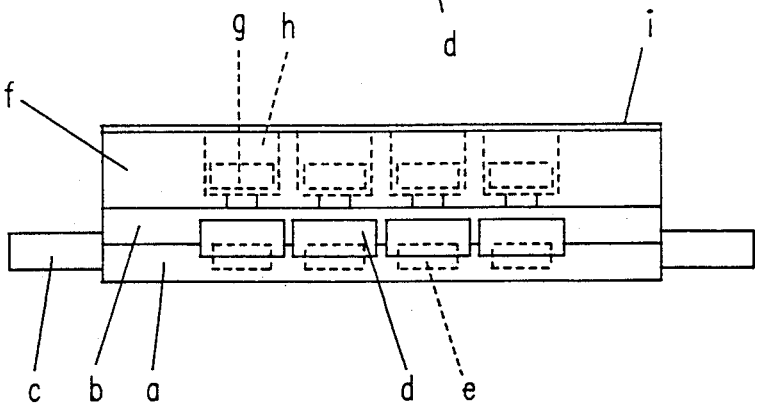

FIGS. 5A, 5B and 5C are side, top and front views of a preferred embodiment of the magnetic puzzle, in which a and b is the confinement for the eight sliding bars c and d, four in each direction, of which two are shown in FIG. 3, holding sixteen sliding tiles e with magnets as shown in FIG. 4, forming the mechanism of moving magnets in the lower matrix of the magnetic puzzle. In the figure, item f is the confinement for the upper layer of magnets g, of which each can turn over in small spaces h, which are covered by a transparent material i to confine the upper magnets to their spaces h.

Figure 6:
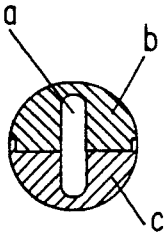

FIG. 6 shows a way of confining a magnet a in a small globe for the upper layer of magnets, which can turn over showing either color b or c to the visible side of the puzzle rather than using small colored discs, as used in the embodiment of FIGS. 5A–5C.

Figure 7A:
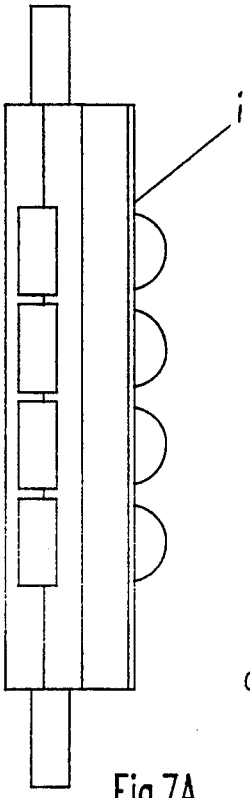
Figure 7B:
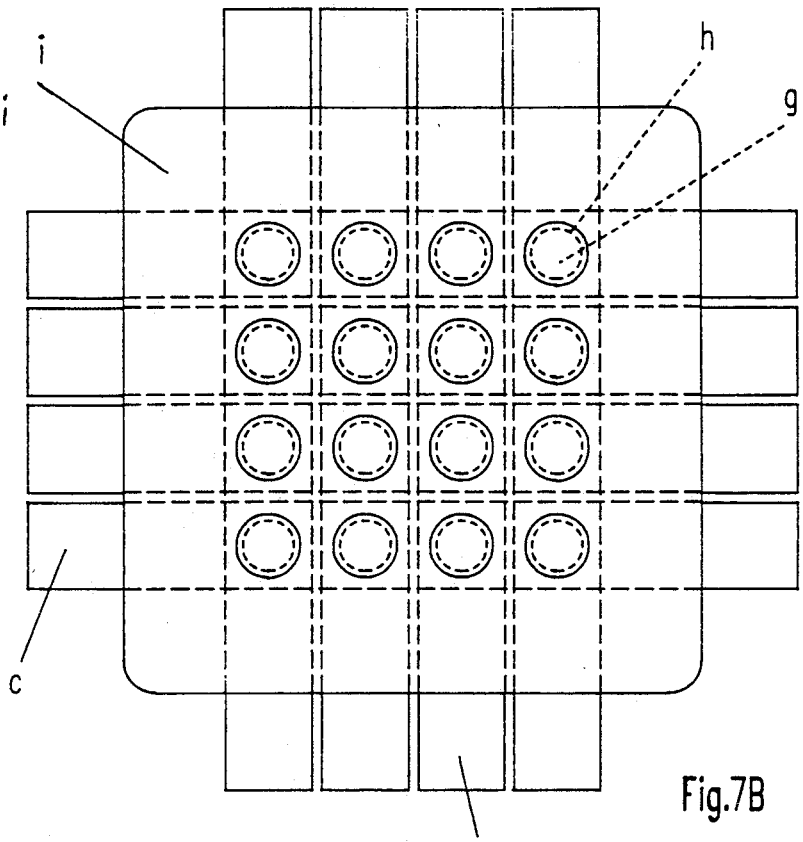
Figure 7C:
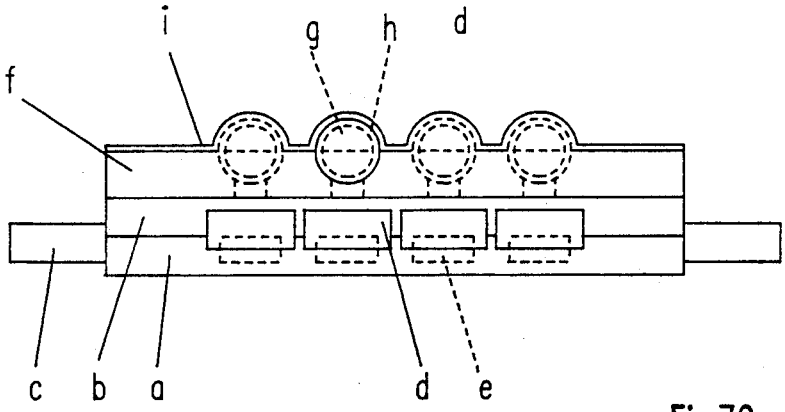

FIGS. 7A, 7B and 7C are side, top and front views of an embodiment wherein the upper layer of magnets is formed by globes of FIG. 6 which holds a magnet a enabling the globe to revolve by the magnetic forces without vertical movement, showing either one color b or c to the visible side of the puzzle.

Figure 8A:
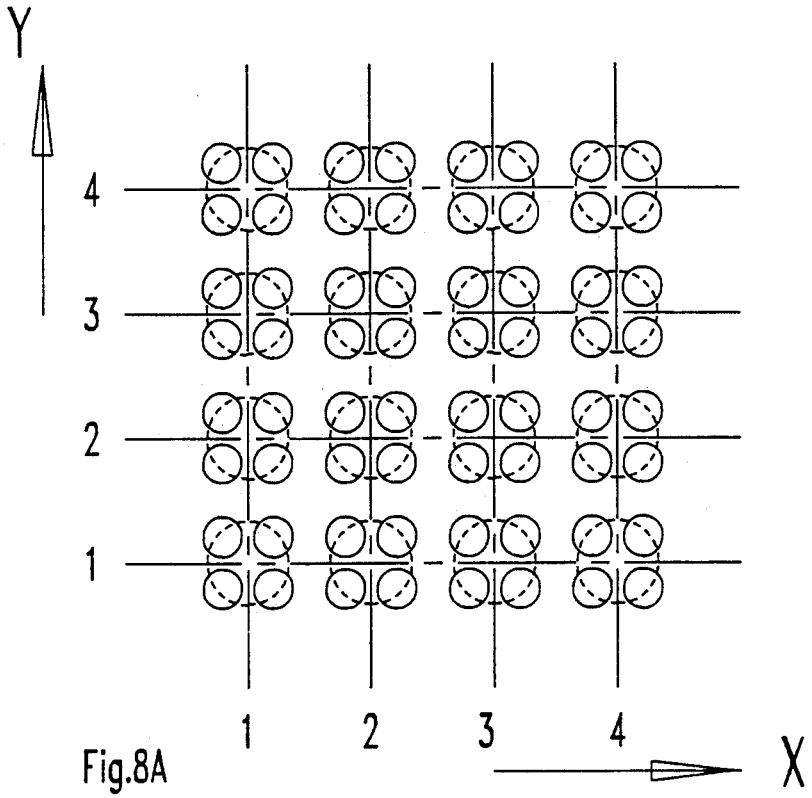
Figure 8B:
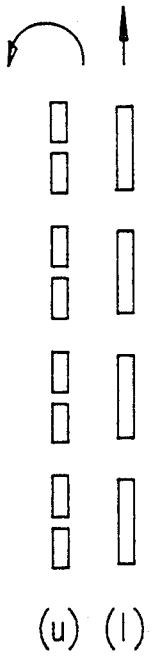
Figure 8C:
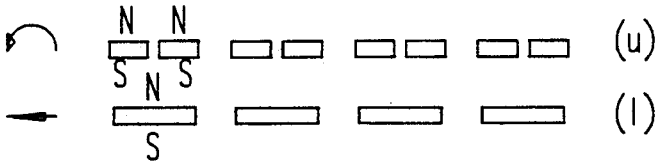

FIGS. 8A, 8B and 8C are top, front and side views of an embodiment having the upper matrix four times the size of the lower matrix of magnets.

Figure 9:
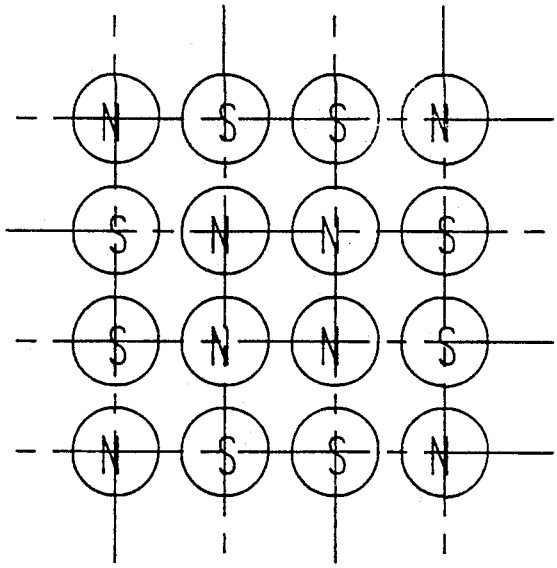
Figure 10:
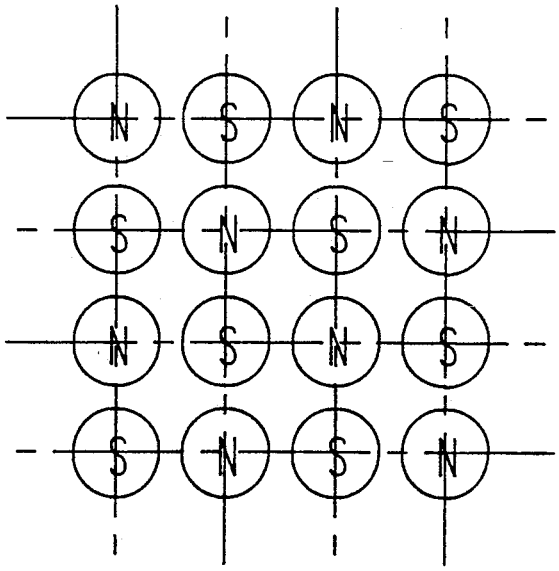

FIGS. 9 and 10 show a pattern of north and south poles of the upper layer of magnets to the visible side of the puzzle which is uniformly colored.

DETAILED DESCRIPTION OF THE PREFERRED EMBODIMENT

The subject invention will now be described relative to the accompanying figures.

Figure 1A:
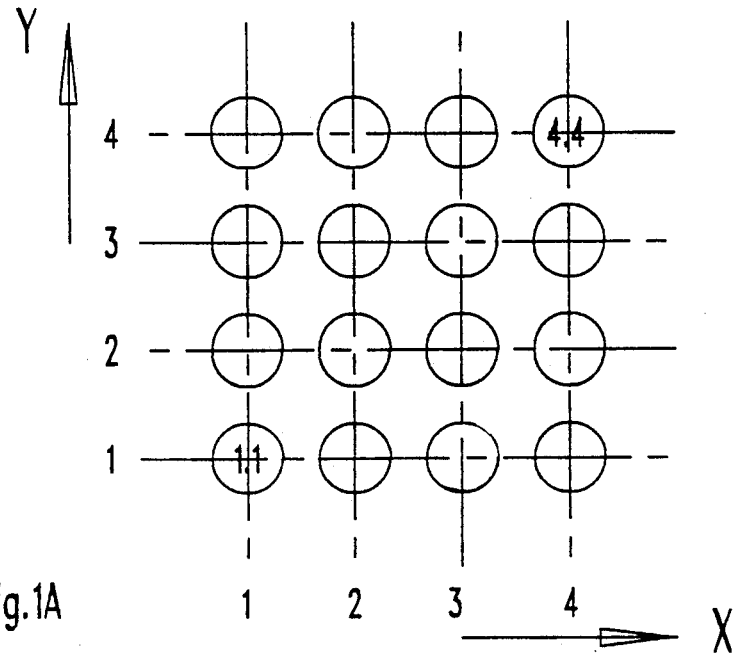
Figure 1B:
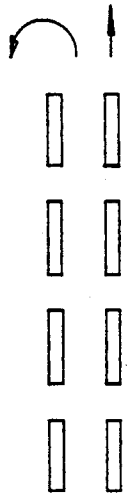
Figure 1C:
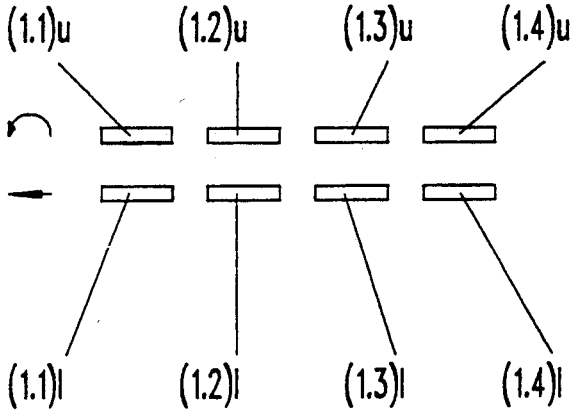
Figure 1D:
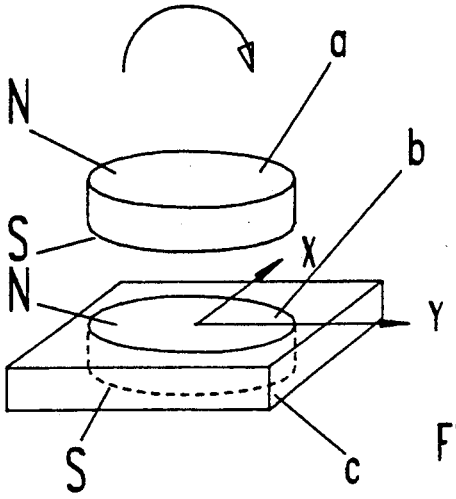

In FIGS. 1A–1C the principle of the invention is shown, whereby two layers of 4×4 matrixes of magnets are positioned directly above one another. Each position of the magnet is defined by its x, y position in the upper or lower layer, by adding either a "u" for upper layer or "l" for lower layer.

The magnets (1.1 . . . 4.4)u are sixteen revolving magnets in the upper layer of which each is colored in two colors on the north and south side whereby about 50% of the magnets should have the north poles colored in one color and the remainder should have the north poles colored in the second color and could be arbitrarily positioned within the matrix at this stage. Each of the upper magnets is confined to its horizontal position, however, can turn over showing either one of the colors at random.

FIGS. 1A–1C show also the lower matrix of magnets directly positioned underneath each of the upper magnets and interact with these magnets. The lower matrix of magnets (1.1 . . . 4.4)l cannot turn and are confined vertically thereby maintaining the north-south direction of magnets, but each of the magnets can change its location within the matrix. Two magnets, one of the upper and one of the lower matrix are shown in FIG. 1-D whereby the colored magnet a can turn over and the lower magnet b can move in two directions x and y.

Figure 2:
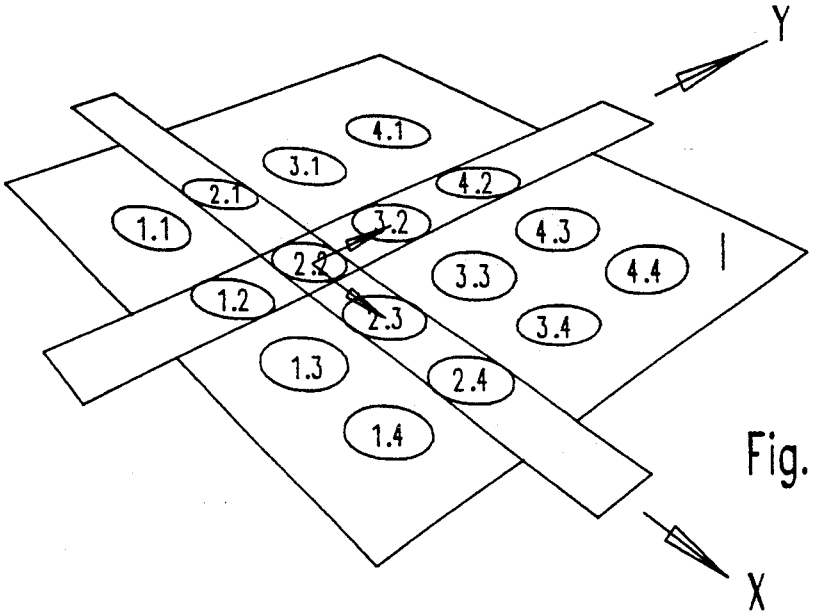
FIG. 2 shows schematically the mechanism of moving the magnets in the lower layer horizontally in x and y direction.

The movements of magnets in the lower layer is accomplished by 4 sliding bars in the x direction and 4 sliding bars in the y direction of which the principle is shown in FIGS. 2 and 3, whereby each of the magnets is capsuled in a small holder, t, (tile) as shown in FIG. 4 with equal or larger thickness than the magnet it is holding. Each sliding bar of which two are shown in FIG. 3 has four little compartments a holding the magnets b. Movement of one of these sliding bars in either direction moves 4 of the magnets at the time one position within the matrix and to be precisely one magnet outside or back into the matrix. By moving these sliding bars one position at the time, each of the magnets in the lower level will change its place within the matrix, as shown in FIG. 2 (e.g. from 2.2 to 2.3 in the x direction or from 2.2 to 3.2 in the y direction), while two of the eight sliding bars (one in the x-direction and one in the y-direction) is shown in FIG. 3 with a magnet holder in FIG. 4 that is moved around in the lower layer of magnets and which are changed position by the movements of the sliding bars of FIGS. 2 and 3.

When the coloring of upper layer of magnets is done arbitrarily, the north-south direction of the lower layer of the individual magnets is chosen in such a way that there is at least one combination of magnets that enable the upper layer to be colored uniformly at the visible side.

FIG. 5 shows the preferred embodiment of the magnetic puzzle in three views. The top view of FIGS. 5A–5C show the 16 colored disc type magnets g at arbitrary coloring position. The eight sliding bars, four in each direction x and y identified as item c and d are held in their confinement a and b of FIG. 5C in such a way that they can slide in x and y direction and enabling to move the lower magnets e around within the lower 4×4 matrix of magnets. Each magnet in the lower matrix is capsuled in a sliding piece (tile) of which four fit within the four compartments of each sliding bar c and d. Each of the revolving sixteen upper colored magnets is confined in little compartments h of the magnet holder f, while the compartments h are closed by a sheet of transparent material i enabling the upper layer of magnets to be visible. The upper layer of magnets could be confined in a transparent material like perspex, plexiglass or acrylate while the lower matrix of magnets is confined in a non transparent material of plastic, wood, non-ferrous metals etc. The upper layer of magnets is not restricted to flat disc type magnets, but could be elongated magnets confined in a globe which globe could turn over within its confinement. Such a globe with magnet is shown in FIG. 6 consisting of two differently colored halves in which a recession is made to hold the magnet and then mounted together. FIGS. 7A–7C show another embodiment of the magnetic puzzle whereby in the upper layer of magnets, globes are used of the type as shown in FIG. 6. In this case the globes can turn over without vertical movement of the magnets as required in the embodiment of FIGS. 5A–5C. Also other configurations for the upper layer are envisioned using cubes or flat square pieces holding magnets inside. Instead of using colors on both sides of the magnets, letters, pictures, cartoons etc. could be used on one or both side of the magnets. The objective of the puzzle becomes then to either complete the pictures or cartoons, or make a sentence or just evenly color the visible side of the magnets in one color.

The subject invention as described is for a matrix of four by four (4×4), however is obviously not restricted to these dimensions. More elaborate matrixes, however, make the puzzle more complex to solve. Additionally the size of the upper matrix needs not to be the same as the size of the lower matrix. In that case, however, the upper matrix should be a multiple of the size of the lower matrix as shown in FIGS. 8–8C.

Also various patterns of coloring the north and south pole magnets in the upper layer are possible of which two samples are shown in FIGS. 9 and 10, providing the solution for an uniformly colored matrix at the visible side of the puzzle. It can be shown that the solution of a puzzle with pattern of FIG. 9 will be more complex than that of FIG. 10.

In the above described embodiments, the upper and lower matrixes have all magnets. In order to make the puzzle even more complex some of the magnets either in the upper layer or in the lower layer or both could be replaced by magnetic neutral material or weak iron without preferred magnetic direction. Movement of the lower matrix will in that case not always have an effect on the direction of some of the upper colored magnets.

We claim:

1. A magnetic puzzle comprising an upper magnet layer and a lower magnet layer, the upper layer comprising a plurality of upper magnet elements arranged in horizontal mutually perpendicular rows extending in X and Y directions in an upper matrix and the lower layer comprising a plurality of lower magnet elements arranged in horizontal mutually perpendicular rows extending in said X and Y directions in a lower matrix under the upper matrix, the upper magnet elements each having distinctively marked north and south pole sides and each being mounted for magnetic force induced turning movements about a horizontal axis selectively to present one of said pole sides facing upwardly, the lower magnet elements being mounted for selected translatory movements in said X and Y directions to adjust the positions of selected lower magnet elements relative to the upper magnet elements and provide magnetic pole shifts effective to produce said turning movements in selected ones of the upper magnet elements.

2. A magnetic puzzle as claimed in claim 1, wherein the lower magnet elements are carried by lower mounting means comprising a holder for each magnet element in which the respective magnet element is mounted, a plurality of elongate Y-direction sliding bars with spaced recesses each receiving a holder of a respective Y-direction row of the lower magnet elements, and a plurality of elongate X-direction sliding bars for sliding over the Y-direction bars, the X-direction bars having spaced recesses facing the recesses in the Y-direction bars and each receiving a holder of a respective X-direction row of lower magnet elements whereby a selected X-direction row of lower magnet elements is moved relative to the upper magnet elements by lengthwise movement of a respective X-direction bar, and a selected Y-direction row of lower magnet elements is moved relative to the upper magnet elements by lengthwise movement of a respective Y-direction bar.

3. A magnetic puzzle as claimed in claim 2, wherein the puzzle is contained in a housing including the lower mounting means and upper mounting means for the upper magnet elements, the upper mounting means comprising means defining individual compartments for the respective upper elements confining each element for said turning movements therein.

4. A magnetic puzzle as claimed in claim 3, wherein each upper magnet element comprises a magnet shaped as a disc and said pole sides comprise upper and lower faces of the disc.

5. A magnetic puzzle as claimed in claim 3, wherein each upper magnet element comprises a bar magnet embedded in a spherical globe, wherein said north and south pole sides comprise hemispherical portions of the globe which receive respective north and south poles of the bar magnet, and wherein each of said compartments is spherically shaped to receive a globe.

6. A magnetic puzzle as claimed in claim 2, wherein selected rows of said upper matrix include non-magnetic elements.

7. A magnetic puzzle as claimed in claim 1, wherein the respective pole sides of each upper magnet element are distinguished by color.

* * * * *